United States Patent [19]

Therrien

[11] 3,957,157

[45] May 18, 1976

[54] DISPLAY CONTAINER

[76] Inventor: Norman W. Therrien, Box 1106, Pittsfield, Mass. 01201

[22] Filed: Aug. 30, 1973

[21] Appl. No.: 392,897

[52] U.S. Cl. ..... 206/.83; 40/323; 206/.84

[51] Int. Cl.[2] ..... A45C 11/28

[58] Field of Search ..... 206/.82, .83, .84; 40/323, 140, 152, 155; 220/46 R, 42 F; 229/92.9; 285/364

[56] References Cited

UNITED STATES PATENTS

| | | | |
|---|---|---|---|
| 84,014 | 11/1868 | Stamn | 220/46 R |
| 1,059,747 | 4/1913 | Montross | 285/364 |
| 1,319,513 | 10/1919 | Colegrove | 40/155 |
| 2,139,150 | 12/1938 | Curtis et al. | 206/.83 |
| 2,156,775 | 5/1939 | Zimmer | 40/140 |
| 2,383,089 | 8/1945 | Theiler | 220/46 R |
| 2,540,718 | 2/1951 | Duskin | 40/140 |
| 2,659,991 | 11/1953 | Strayer | 40/152 |
| 2,689,421 | 9/1954 | Lesniak et al. | 40/140 |
| 2,942,520 | 6/1960 | Rose | 206/.83 |
| 2,982,437 | 5/1961 | Wheatley | 220/46 R |
| 2,998,126 | 8/1961 | Jenkins | 206/.83 |
| 3,028,949 | 4/1962 | Sohosky | 206/.83 |
| 3,199,666 | 8/1965 | Burdick | 206/.82 |
| 3,530,978 | 9/1970 | Lewandowski | 220/345 |
| 3,554,625 | 1/1971 | Sly, Sr. | 206/.83 |

*Primary Examiner*—William Price
*Assistant Examiner*—Allan N. Shoap
*Attorney, Agent, or Firm*—Ladas, Parry, Von Gehr, Goldsmith & Deschamps

[57] ABSTRACT

An easily assemblable and disassembable air-tight container or display holder for coins or similar articles. A holding plate having a hole in which the article is placed is sandwiched between retaining plates, a seal is placed about the periphery of the holding plate and between the retaining plates, and a framing assembly is positioned about the periphery of the plates to hold the retaining plates against the seal. An identifying piece is removably interlocked into the framing assembly.

6 Claims, 6 Drawing Figures

DISPLAY CONTAINER

BACKGROUND OF THE INVENTION

1. Field of the Invention

This invention relates to an improved holder for display of coins or similar articles.

2. Description of the Prior Art

Holders for storage or display of coins or similar articles are used by coin collectors and dealers to store or display coins and medallions. It is advantageous for such holders to be air-tight, so as to limit or eliminate oxidation of the contained articles, especially articles of silver, copper or brass. Air-tightness has been achieved by gluing or permanently sealing together the parts of the holder, but a disadvantage of such holders is that they must be broken open to effect removal of the contained object. A method of achieving air-tightness has been to fasten the parts of the holder snugly with rivets, screws or bolts, so that little air can pass into the holder, but tools are required for assembly or disassembly, and often such containers must be destroyed on disassembly. Further, such holders do not guarantee air-tightness, but merely restrict the flow of air, reducing, but not eliminating, oxidation of contained articles.

It is often desired to provide an opaque field against which to display the contained article, and the changing of such fields in existing holders has the disadvantages of assembly and disassembly mentioned in the preceding paragraph.

It is usually desired to include an identification of the contained article in the holder. Identification is commonly placed on a major piece of the holder, so that even if certain parts of the container reusable after disassembly, parts marked with identification could properly be reused only with articles fitting the inscribed identification.

SUMMARY OF THE INVENTION

It is an object of the invention to provide a holder which is air-tight and yet is easily assemblable and disassemblable without the use of tools. A further object is to provide a display holder which permits ease of interchange of contents. Yet another object is to provide ease of varying combinations of colors for the various parts of the holder. A further object is to provide ease of change of identifying markings on the holder.

According to the present invention, air-tightness is achieved by sandwiching a seal between the plates which retain the article to be contained. The article to be contained may fit in a recess in the retaining plates or may be placed in a hole in a holding plate, about which the seal is placed, the assembly then being sandwiched between the retaining plates so that the seal is compressed against the retaining plates. A framing member is placed about the periphery of the retaining plates to hold them against the seal, and may fit into grooves in the retaining plates. An identifying piece may be placed into or about a section of the framing member, fitting into a recess in the framing member.

If articles of different thicknesses are to be held in the container by means of the holding plate, a lifter may be used to occupy the excess space between the thinner articles and the retaining plate, or the retaining plate may have a boss of appropriate thickness projecting into the holding plate.

DESCRIPTION OF THE PREFERRED EMBODIMENT

Figure 1:
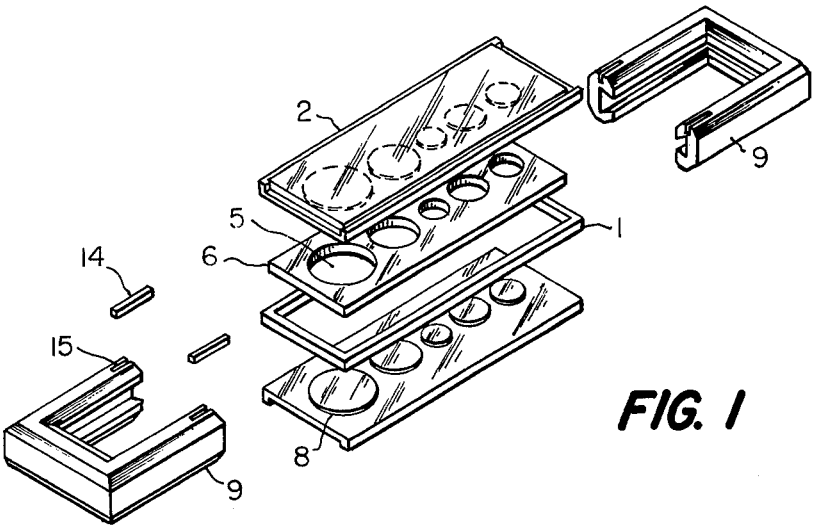
FIG. 1 is a exploded view of the preferred embodiment of the holder.
Figure 2:
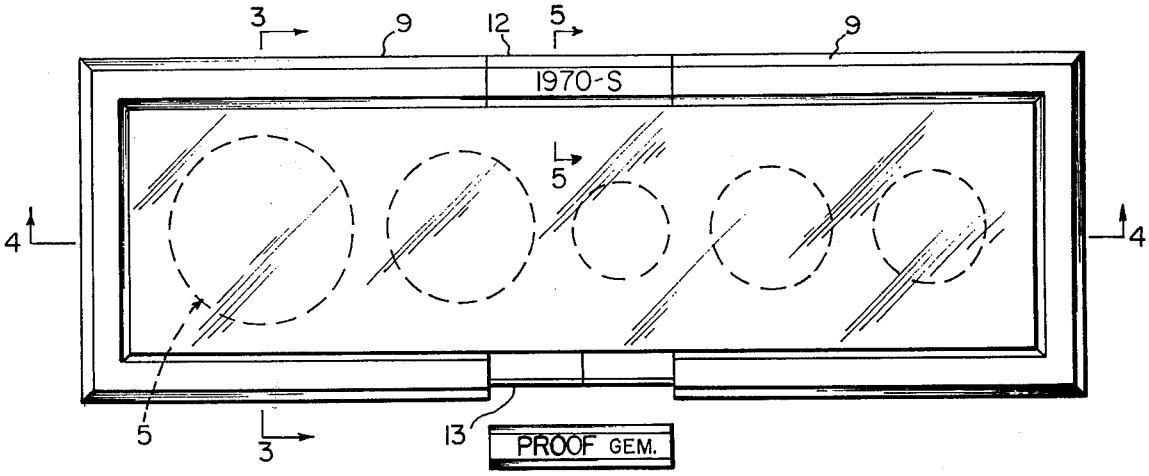
FIG. 2 is a top plan view of the assembled holder, with alternate means of identification.
Figure 3:
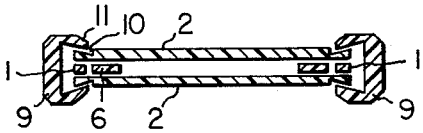
FIG. 3 is a sectional view of the assembled holder taken on line 3—3 of FIG. 2.

According to the present invention, air-tightness is achieved by sandwiching a seal 1 between the retaining plates 2 which retain the article to be contained. The retaining plates should be rigid and impermeable to air, and if the contained article is to be displayed, the retaining plates should be transparent. The seal should be air-impermeable resilient material which, when compressed against the retaining plated, forms air-tight seals thereagainst. The seal 1 between the retaining plates should be continuous about the contained article. If the seal is to be reusable it must be resilient, so that when the container is disassembled and reassembled, the seal will re-seat against the retaining plates. I have found that the combination of styrene plastic for the retaining plates and closed-cell neoprene for the seal can provide the requisite air-tightness.

If the contained article is to be held in a fixed position within the container, the retaining plates may have a recess 3 in a shape complimentary to the article to be contained, and the seal may be fitted between the retaining plates. A groove 4 may be located in one or both retaining plates in order to fix the position of the seal.

A preferred method of fixing the position of the contained article is to locate it within a hole 5 in a holding plate 6 and sandwich the holding plate and the article between the retaining plates. The holding plate should be at least as thick as the article to be contained. A seal may be positioned between the holding plate and each of the retaining plates, or a single seal may be placed about the periphery of the holding plate and of greater thickness than the holding plate, and sandwiched between the retaining plates.

Figure 4:
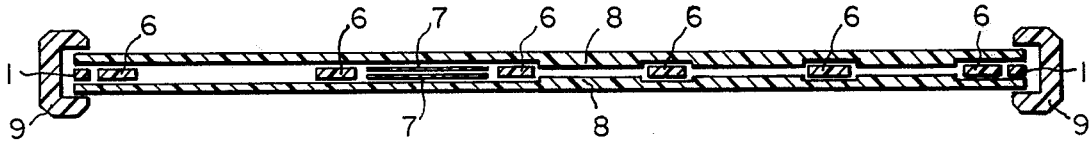
FIG. 4 is a sectional view of the assembled holder taken on line 4—4 of FIG. 2.
Figure 5:
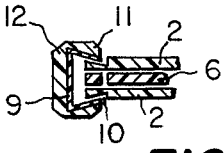
FIG. 5 is a partial sectional view of the assembled holder taken on line 5—5 of FIG. 2, showing an alternative form of the identifying piece.
Figure 6:
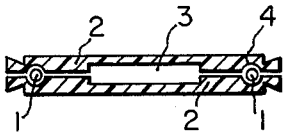
FIG. 6 is a cross section of an alternative embodiment of the assembled holder taken on line 3—3 of FIG. 2.

If a plurality of articles of unequal thickness are to be contained in fixed locations, and it is desirable that there be no excess air within the container, the holding plate should be at least as thick as the thickest article and have holes only slightly larger than the lateral dimensions of the articles; the space between the thinner articles and the retaining plates may be taken up by lifters 7 placed in the holes or by bosses 8 on the retaining plates, as shown in FIG. 4. The advantages of embossing the retaining plates are that the bosses serve to locate the holding plate in relation to the retaining plates and if the article is to be viewed, there are no extra solid-air surfaces between the viewer and the article, so there is no added optical interference.

The retaining plates should be held in fixed relationship to each other, and means should be provided for compressing the seal against the retaining plates. According to the invention, a rigid locking piece 9 may be placed about the periphery of the retaining plates as a framing member, as shown in FIG. 1. A plurality of locking pieces may be used, A groove 10 may be made along the external side of the retaining plates, near the periphery, along which an inward projection 11 of the locking piece may be slid, providing easy assembly and means for preventing the locking piece from accidentally slipping off the holder.

Identification of articles may be placed on a channel-shaped identifying piece 12 which is slipped in a transverse groove 13 about the outer edge of the locking piece. The identifying piece may be located across and concealing the juncture of two locking pieces.

The preferred means of identification is the use of an identifying piece 14 removably interlocked in a longitudinal channel 15 in the locking piece.

In the preferred embodiment, a colored or opaque holding plate 6 containing a plurality of holes 5 for coins of different sizes with a closed-cell neoprene seal 1 about the periphery of the holding plate, is sandwiched between a pair of transparent styrene retaining plates 2 with bosses 8, the retaining plates being compressed against the seal by means of locking pieces 9 having projections 11 which fit into grooves 10 along the side of the retaining plates, with an identifying piece 14 fit into a groove 15 on the locking piece.

What is claimed is:

1. A container comprising a holding plate having one or more holes therethrough, a continuous resilient, air-impermeable sealing member positioned about the periphery of the holding plate, and first and second air-impermeable retaining plates in contact with the sealing member on either side of the holding plate, the two retaining plates being fitted in a frame defining a channel-section recess which extends about the periphery of the retaining plates and in which edge portions of the retaining plates are received to compress the retaining plates against the sealing member thereby to form air-tight seals between the sealing member and the retaining plates respectively, the frame including at least two frame members both of which are readily movable to permit disassembly of the container and are readily replaceable to facilitate reassembly of the container, and at least one of the retaining plates being transparent and being formed with a boss of uniform height less than the thickness of the holding plate, the boss protruding into one of the holes in the holding plate and being of substantially the same cross-sectional form as said one hole.

2. A container as described in claim 1, wherein one of said frame members is formed with a groove at a free end thereof and another of said frame members is also formed with a groove at a free end thereof, said grooves being in alignment and communication with one another, and wherein the container also comprises an elongated identifying piece having one end fitted in one of said grooves and its opposite end fitted in the other groove.

3. A container as described in claim 1, wherein one of said frame members has a region of reduced cross section at a free end thereof and another of said frame members also has a region of reduced cross-section at a free end thereof, said free ends being in alignment with one another so that the regions of reduced cross section together form a groove extending transversely with respect to the frame members and across the juncture therebetween, and wherein the container also comprises a channel section identifying piece fitted in the groove and concealing said juncture.

4. A container as described in claim 1, wherein both of said retaining plates are transparent.

5. A container as described in claim 1 in which each of the retaining plates has an outer main face and is formed with a groove in its outer main face near the periphery thereof, and the frame members are formed with projecting portions engaging in said grooves and slidable along said grooves to remove and replace said frame members.

6. A container as described in claim 5, wherein said one frame member is formed with a channel at a free end thereof and another of said frame members is also formed with a channel at a free end thereof, said channels being in alignment and communication with one another, and wherein the container also comprises an elongated identifying piece having one end fitted one of said channel and its opposite end fitted in the other channel and being removable from said channels by sliding said one frame member along said grooves to remove said one frame member.

* * * * *